US006633119B1

(12) United States Patent
Chalamala et al.

(10) Patent No.: US 6,633,119 B1
(45) Date of Patent: Oct. 14, 2003

(54) FIELD EMISSION DEVICE HAVING METAL HYDRIDE HYDROGEN SOURCE

(75) Inventors: Babu R. Chalamala, Chandler, AZ (US); Robert H. Reuss, Fountain Hills, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/572,529

(22) Filed: May 17, 2000

(51) Int. Cl.[7] ..... H01J 1/62
(52) U.S. Cl. ..... 313/495; 313/309
(58) Field of Search ..... 313/309, 311, 313/336, 351, 346 R, 495–97, 551–55, 558–59, 561, 563, 566–67

(56) References Cited

U.S. PATENT DOCUMENTS

| | | | | |
|---|---|---|---|---|
| 5,223,766 A | * | 6/1993 | Nakayama et al. | 313/495 |
| 5,578,900 A | * | 11/1996 | Peng et al. | 313/495 |
| 5,772,485 A | | 6/1998 | Jeng et al. | |
| 5,864,205 A | * | 1/1999 | Dworsky | 313/495 |
| 5,883,467 A | | 3/1999 | Chalamala et al. | |
| 5,907,215 A | | 5/1999 | Mougin et al. | |
| 5,934,964 A | | 8/1999 | Carella | |
| 5,945,780 A | | 8/1999 | Ingle et al. | |
| 5,955,140 A | | 9/1999 | Smith et al. | |
| 6,042,443 A | | 3/2000 | Carella | |
| 6,100,627 A | * | 8/2000 | Carretti et al. | 313/309 |

FOREIGN PATENT DOCUMENTS

| | | |
|---|---|---|
| EP | 0 455 162 A | 11/1991 |
| EP | 0 802 599 A | 10/1997 |
| EP | 0 996 141 A | 4/2000 |
| FR | 2 781 081 A | 1/2000 |
| JP | 10 255660 | 9/1998 |
| WO | WO 95 23425 A | 8/1995 |
| WO | WO 96 01492 A | 1/1996 |

* cited by examiner

*Primary Examiner*—Vip Patel
*Assistant Examiner*—Joseph Williams
(74) *Attorney, Agent, or Firm*—William E. Koch

(57) ABSTRACT

A field emission display (100, 200) includes a cathode plate (102, 302), an anode plate (104, 204, 304), and a hydrogen source (146, 148, 129, 150, 246, 346, 270), which is preferably disposed on cathode plate (102, 302) or anode plate (104, 204, 304). Hydrogen source (146, 148, 129, 150, 246, 346, 270) is distributed over the active area of field emission display (100, 200) and is made from a metal hydride, which is selected from the group consisting of titanium hydride, vanadium hydride, zirconium hydride, hafnium hydride, niobium hydride, and tantalum hydride. The metal hydride can be activated to provide an isotope of hydrogen in situ.

21 Claims, 1 Drawing Sheet

FIELD EMISSION DEVICE HAVING METAL HYDRIDE HYDROGEN SOURCE

FIELD OF THE INVENTION

The present invention pertains to the area of field emission devices and, more particularly, to field emission displays having in situ hydrogen sources.

BACKGROUND OF THE INVENTION

Field emission devices having in situ hydrogen sources are known in the art. For example, Jeng et al (U.S. Pat. No. 5,772,485) describe a field emission display having a dielectric layer, which is made from hydrogen silsesquioxane (HSQ) and is capable of desorbing at least ten atomic percent hydrogen. Jeng et al teach that the dielectric layer is distributed on the cathode plate of the field emission display. While the distributed HSQ keeps deleterious oxides from forming on microtip emitters, it does not function as a getter for the adsorption of contaminants. If distributed gettering is desired, an additional, distributed gettering structure is required. Provision of a distributed getter thus necessitates additional process steps and materials. It does not appear that a distributed hydrogen source, which also functions as a getter, exists in the prior art.

Accordingly, there exists a need for an improved field emission device having a distributed hydrogen source, which can further function as a getter.

Figure 1:
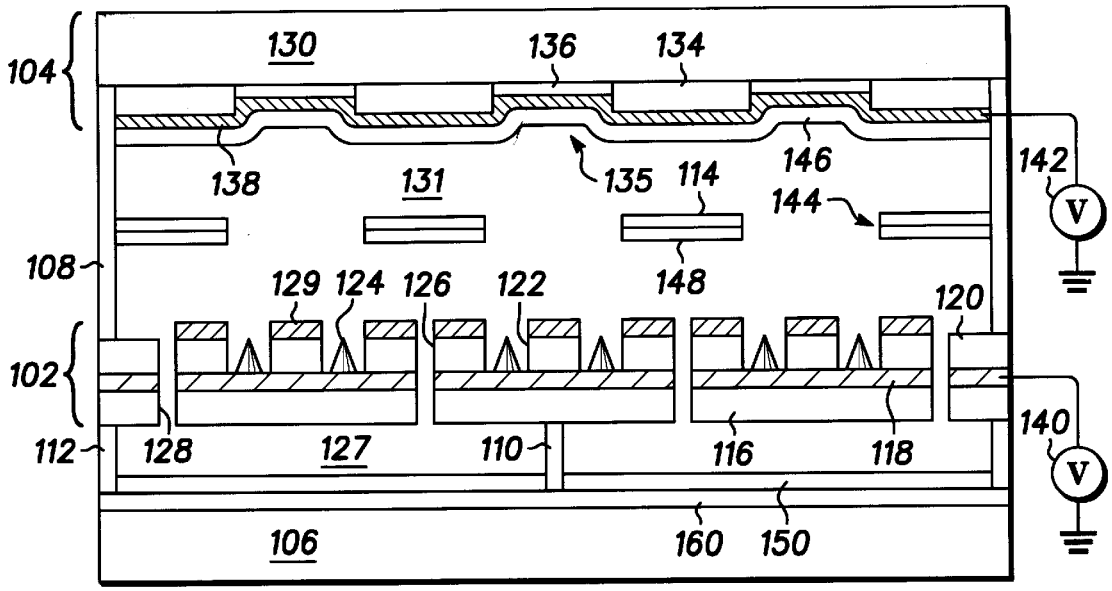
FIG. 1 is a cross-sectional view of an embodiment of a field emission display having hydrogen sources, in accordance with the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission device having a hydrogen source made from a metal hydride, wherein the metal is one of the Group IVB or Group VB metals. The hydrogen source of the invention is useful for in situ generation of an isotope of hydrogen. The hydrogen isotope is useful for improving the performance and life of the field emission device. It is believed that, among other things, the hydrogen isotope reduces oxides on the electron emitters of the device, thereby improving the emission characteristics of the electron emitters. Subsequent to the evolution of the hydrogen gas, the metal that remains can function as a getter useful for the adsorption of contaminant species. Prior to its evolution, the hydrogen of the metal hydride passivates the getter by preventing the adsorption of water, oxygen, and the like. This preservation of the gettering function is particularly useful at times prior to the evacuation of the device package and during the step of sealing the device package. Furthermore, the hydrogen-metal bonds of the hydrogen source of the invention are thermally stable. The thermal stability of the hydrogen source results in several benefits. For example, the hydrogen source of the invention is not completely depleted of hydrogen during the step of sealing the package or during a single performance of the step of activating the hydrogen source.

The invention is embodied, for example, by a field emission device having at least one of the hydrogen sources illustrated in the figures described herein. Furthermore, while the field emission devices described herein are directed to field emission display devices, the scope of the invention is not intended to be limited to display devices. In general, the invention can be embodied by a field emission device that employs electron emitters, which are designed to emit electrons by the application of an electric field of suitable strength.

Furthermore, a hydrogen source in accordance with the invention is made from one of the following metal hydrides: titanium hydride, represented by the formula $TiH_{x\leqq 2}$; vanadium hydride, represented by the formula $VH_{x\leqq 2}$; zirconium hydride, represented by the formula $ZrH_{x\leqq 2}$; hafnium hydride, represented by the formula $HfH_{x\leqq 2}$; niobium hydride, represented by the formula $NbH_{x\leqq 2}$; or tantalum hydride, represented by the formula $TaH_{x\leqq 2}$, wherein the symbol "H" represents an isotope of hydrogen. Descriptions herein regarding hydrogen are applicable to deuterium as well. Preferably, the hydrogen source of the invention is made from titanium hydride, vanadium hydride, or zirconium hydride. The metal hydride of the hydrogen source can be stoichiometric or nonstoichiometric. Preferably, the hydrogen source of the invention is stoichiometric ($TiH_2$, $VH_2$, $ZrH_2$, $HfH_2$, $NbH_2$, or $TaH_2$).

The selection of metal hydride for use in a hydrogen source, in accordance with the invention, can be based upon the thermal stability of the metal hydride. For example, the metal hydride can be selected for compatibility with the maximum temperature reached during the step of sealing the device. For example, titanium hydride is thermally stable up to about 500° C., whereas vanadium hydride and zirconium hydride are thermally stable up to about 800° C.

The hydrogen source of the invention can be designed to realize substantial depletion of the hydrogen content early in the life of the field emission device. In this example, the hydrogen source functions only as a getter during a substantial portion of the lifetime of the field emission device. Alternatively, the hydrogen source can be designed and operated to have hydrogen content throughout most or all of the lifetime of the field emission device.

Several other benefits are realized by the provision of a hydrogen source, in accordance with the invention. For example, because the metal hydride is a chemical compound, in which the hydrogen is chemically bonded to the metal, the thermal stability of the hydrogen source is high, as contrasted with hydrogen sources made from materials, such as alloys, that retain hydrogen by mere physical entrapment. Furthermore, the deposition of the hydrogen source as a thin film can be readily achieved, and the properties of the hydrogen source can be readily predicted.

The hydrogen source of the invention can be made at low cost and can be formed on a variety of types of substrates. One method useful for making the hydrogen sources of the invention is taught by Delfino, et al, in published international patent application number WO 97/31390 with reference to FIG. 3 therein, the relevant portions of which are hereby incorporated by reference. Another method useful for depositing a layer of metal hydride is taught by Steinberg, et al, in U.S. Pat. No. 4,055,686, the relevant portions of which are hereby incorporated by reference.

Preferably, the hydrogen source of the invention is distributed over the active region of the device, thereby defining a distributed hydrogen source. Preferably, the hydrogen source of the invention is a thin film. Most preferably, the hydrogen source of the invention defines a thin film having a thickness equal to less than 5 micrometers.

FIG. 1 is a cross-sectional view of an embodiment of a field emission display (FED) 100 having hydrogen sources, in accordance with the invention. FED 100 includes a cathode plate 102 and an anode plate 104. Cathode plate 102 is spaced apart from anode plate 104 by a frame 108. A focus grid 114 is interposed between anode plate 104 and cathode plate 102. A back plate 106 is attached to cathode plate 102.

Cathode plate 102 includes a substrate 116, which can be made from glass, silicon, ceramic, and the like. A cathode 118 is disposed upon substrate 116. Cathode 118 is connected to a first voltage source 140. A dielectric layer 120 is disposed upon cathode 118 and defines a plurality of emitter wells 122. Dielectric layer 120 further defines a plurality of holes 126, which are in registration one each with a plurality of holes 128 defined by substrate 116.

An electron emitter 124 is disposed within each of emitter wells 122. In the embodiment of FIG. 1, electron emitter 124 is a Spindt tip emitter. However, the invention can be embodied by a field emission device having electron emitters other than Spindt tip emitters, such as surface emitters, edge emitters, structures made using carbon nanotubes, and the like.

Cathode plate 102 further includes a plurality of gate extraction electrodes 129, which are disposed on dielectric layer 120 and are connected to a second voltage source (not shown). Application of selected potentials to cathode 118 and gate extraction electrodes 129 can cause electron emitters 124 to emit electrons.

Anode plate 104 is spaced apart from cathode plate 102 to define an interspace region 131 therebetween. Anode plate 104 includes a transparent substrate 130 made from a solid, transparent material, such as a glass. A black matrix 134 is disposed on transparent substrate 130 and is preferably made from chrome oxide. A plurality of phosphors 136 are disposed one each within a plurality of openings 135 defined by black matrix 134. Phosphors 136 are cathodoluminescent and emit light upon activation by electrons emitted by electron emitters 124.

An anode 138, which is preferably made from aluminum, defines a blanket layer overlying phosphors 136 and black matrix 134. Anode 138 is connected to a third voltage source 142. Methods for fabricating cathode plates and anode plates for matrix-addressable FEDs are known to one of ordinary skill in the art.

Back plate 106 is made from a hard material, such as glass, silicon, ceramic, and the like. Back plate 106 is spaced apart from cathode plate 102 by a spacer 110 and a frame 112 to define an interspace region 127 therebetween. Holes 126 and 128 defined by dielectric layer 120 and substrate 116, respectively, allow communication between interspace regions 131 and 127.

FED 100 has several embodiments of a hydrogen source, in accordance with the invention. In general, each hydrogen source is spaced apart from electron emitters 124 to define an interspace region therebetween suitable for the movement of hydrogen from the hydrogen source to electron emitters 124.

The hydrogen sources depicted in FIG. 1 are distributed hydrogen sources. A first hydrogen source 146 of FED 100 is distributed over anode plate 104. First hydrogen source 146 defines a thin-film, blanket layer, which is disposed on the surface defined by anode 138. The interposition of anode 138 between first hydrogen source 146 and phosphors 136 protects phosphors 136 during the deposition of first hydrogen source 146. The thickness of first hydrogen source 146 is selected to control loss of energy by electrons as they traverse first hydrogen source 146. For example, first hydrogen source 146 can have a thickness equal to about 500 angstroms.

Prior to the deposition of first hydrogen source 146, anode 138 typically has an oxide layer. Beneficially, the oxide layer is reduced during the deposition of first hydrogen source 146.

In general, a hydrogen source in accordance with the invention is operably connected to an activating means for activating the hydrogen source. The hydrogen source is activated to release hydrogen by, for example, resistive heating and/or electron bombardment of the hydrogen source. For example, first hydrogen source 146 is caused to release hydrogen during the electronic activation of phosphors 136.

FED 100 also has a second hydrogen source 148, which is disposed on focus grid 114. Focus grid 114 is made from a conductor, such as copper, nickel, and the like. Focus grid 114 defines a plurality of holes 144 and is connected to a voltage source (not shown). Focus grid 114 is useful for focusing electrons as they pass through holes 144 toward phosphors 136. Second hydrogen source 148 is deposited on focus grid 114 as a thin film of metal hydride, in accordance with the invention. Second hydrogen source 148 can be activated, for example, by the resistive heating of focus grid 114.

In the embodiment of FIG. 1, gate extraction electrodes 129 also define hydrogen sources, in accordance with the invention. In the embodiment of FIG. 1, gate extraction electrodes 129 are thus made from a metal hydride, which is selected from the group consisting of titanium hydride, vanadium hydride, zirconium hydride, hafnium hydride, niobium hydride, and tantalum hydride. Because they are not traversed by field-emitted electrons, as is first hydrogen source 146, hydrogen sources defined by gate extraction electrodes 129 can be made substantially thicker than first hydrogen source 146. Gate extraction electrodes 129 can be activated to release hydrogen by resistive heating. They can also be activated by causing field-emitted electrons to be directed toward gate extraction electrodes 129. These activating electrons are also useful for causing electron-impact ionization of the evolved hydrogen.

Further illustrated in FIG. 1, is a fourth hydrogen source 150, which is disposed within interspace region 127 between back plate 106 and cathode plate 102. Fourth hydrogen source 150 is formed on a resistive film 160 that is disposed on the interior surface of back plate 106. Resistive film 160 is connected to a voltage source (not shown) useful for causing the activation of fourth hydrogen source 150 by resistive heating of resistive film 160. Subsequent to its evolution from fourth hydrogen source 150, hydrogen travels through holes 128 and 126 to access electron emitters 124.

Figure 2:
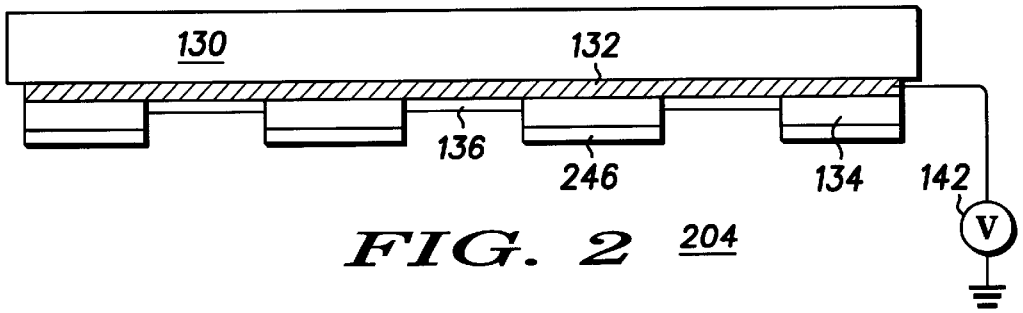
FIG. 2 is a cross-sectional view of an anode plate of another embodiment of a field emission display, in accordance with the invention.

FIG. 2 is a cross-sectional view of an anode plate 204 of another embodiment of a field emission display, in accordance with the invention. In the embodiment of FIG. 2, a hydrogen source 246 is deposited directly on black matrix 134. Anode plate 204 further includes an anode 132, which is disposed on transparent substrate 130 and is made from a transparent conductor, such as indium tin oxide. Hydrogen source 246 can have a thickness greater than that of first hydrogen source 146 (FIG. 1) because it is not traversed by the field-emitted electrons. Furthermore, because hydrogen source 246 it is not traversed by the field-emitted electrons, it does not reduce their energy for activating phosphors 136.

This does not foreclose the option of using field-emitted electrons to activate hydrogen source 246. For example, electronic activation of hydrogen source 246 can be achieved by making the spot size at anode plate 204 of an electron beam, which is directed toward one of phosphors 136, greater than the area of one of phosphors 136. In this manner, a portion of the electron beam causes activation of hydrogen source 246, while the remainder causes activation of phosphor 136.

Figure 3:
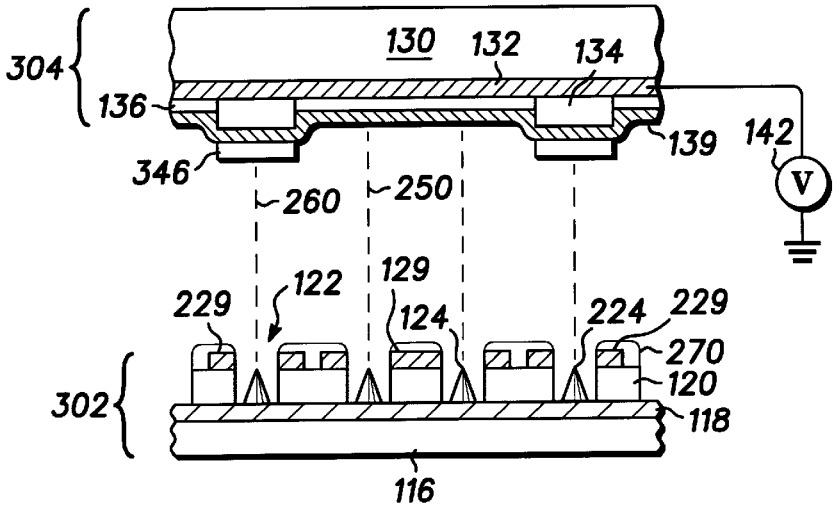
FIG. 3 is a cross-sectional view of a further embodiment of a field emission display having a hydrogen source, which is patterned on the anode plate and can be independently activated, in accordance with the invention.

Another method for activating a hydrogen source, which is disposed on the anode plate, is illustrated in FIG. 3. FIG. 3 is a cross-sectional view of a further embodiment of a field emission display (FED) 200 having a hydrogen source 346, which is patterned on an anode plate 304 and which can be independently activated, in accordance with the invention. Hydrogen source 346 can be activated at times when phosphors 136 that are adjacent to hydrogen source 346 are not being activated.

In the embodiment of FIG. 3, hydrogen source 346 is disposed on a reflective layer 139. Reflective layer 139 can be made from aluminum and is useful for reflecting light toward the viewer of an image created by FED 200. In the embodiment of FIG. 3, reflective layer 139 is distinct from anode 132.

A cathode plate 302 of FED 200 includes a second plurality of electron emitters 224. Electron emitters 224 can be selectively addressed using a second plurality of gate extraction electrodes 229. Thus, electron emitters 124 provide electrons, which are represented by a dashed line 250, for the activation of phosphors 136, and electron emitters 224 provide electrons, which are represented by a dashed line 260, for the activation of hydrogen source 346. If desired, hydrogen source 346 can also be activated by making the spot size of the phosphor-activating electrons sufficiently large, in the manner described with reference to FIG. 2.

FIG. 3 illustrates a further embodiment of a hydrogen source 270, in accordance with the invention. In the embodiment of FIG. 3, gate extraction electrodes 129 are not made from titanium hydride. Rather, they are made from a conductor, such as aluminum.

Hydrogen source 270 is made from a metal hydride, in accordance with the invention, and is deposited as a blanket layer on cathode plate 302. The thickness of hydrogen source 270 is selected to prevent the electrical shorting of gate extraction electrodes 129 and 229.

Hydrogen source 270 is useful for preventing the accumulation of static electrical charge at the interior surface of cathode plate 302 by providing a slightly conductive pathway. That is, hydrogen source 270 functions as a bleed-off layer as well as a source of hydrogen and getter.

In summary, the invention is for a field emission device having a hydrogen source made from a metal hydride, which is selected from the group consisting of titanium hydride, vanadium hydride, zirconium hydride, hafnium hydride, niobium hydride, and tantalum hydride. The hydrogen source of the invention obviates the need for separate elements to provide a getter and hydrogen gas. The hydrogen source of the invention can be provided at low cost and can readily be deposited as a thin film, thereby facilitating a distributed configuration. Incorporation of the hydrogen source in the device is further facilitated by the fact that the hydrogen source of the invention is thermally stable. That is, because the hydrogen source of the invention is not substantially depleted upon heating at sealing temperatures, it can be incorporated into the device prior to the step of sealing the package.

While we have shown and described specific embodiments of the present invention, further modifications and improvements will occur to those skilled in the art. For example, the invention is also embodied by a field emission device having a hydrogen source, which is not distributed over the active region of the device. The hydrogen source of this embodiment can be located at the peripheral regions of the device, outside of the screen area. As a further example, the invention is embodied by a field emission device having a hydrogen source, which is made prior to its inclusion in the device. The hydrogen source of this embodiment can be preformed into a bar and thereafter affixed to an interior surface of the device. As yet a further example, the hydrogen source of the invention is embodied by a layer that caps each of the gate extraction electrodes, which are made from a conductive material that is distinct from the metal hydride of the hydrogen source.

We desire it to be understood, therefore, that this invention is not limited to the particular forms shown, and we intend in the appended claims to cover all modifications that do not depart from the spirit and scope of this invention.

We claim:

1. A field emission device comprising an electron bombardment activated hydrogen source comprising a metal hydride selected from the group consisting of titanium hydride, vanadium hydride, zirconium hydride, hafnium hydride, niobium hydride, and tantalum hydride.

2. The field emission device as claimed in claim 1, wherein the an electron bombardment activated hydrogen source comprises a metal hydride selected from the group consisting of titanium hydride, vanadium hydride, and zirconium hydride.

3. The field emission device as claimed in claim 1, wherein the an electron bombardment activated hydrogen source comprises a distributed hydrogen source.

4. The field emission device as claimed in claim 1, wherein the metal hydride is stoichiometric.

5. A field emission device comprising:

a plurality of electron emitters; and a hydrogen source spaced apart from the plurality of electron emitters to define an interspace region therebetween suitable for the movement of hydrogen from the hydrogen source in response to an electron bombardment, to the plurality of electron emitters, wherein the hydrogen source comprises a metal hydride selected from the group consisting of titanium hydride, vanadium hydride, zirconium hydride, hafnium hydride, niobium hydride, and tantalum hydride.

6. The field emission device as claimed in claim 5, wherein the hydrogen source comprises a metal hydride selected from the group consisting of titanium hydride, vanadium hydride, and zirconium hydride.

7. The field emission device as claimed in claim 5, wherein the hydrogen source comprises a distributed hydrogen source.

8. The field emission device as claimed in claim 5, wherein the metal hydride is stoichiometric.

9. The field emission device as claimed in claim 7, further comprising an anode plate, and wherein the hydrogen source is distributed over the anode plate.

10. The field emission device as claimed in claim 9, wherein the anode plate defines a surface opposing the plurality of electron emitters, and wherein the hydrogen source defines a blanket layer disposed on the surface defined by the anode plate.

11. The field emission device as claimed in claim 5, wherein the hydrogen source defines a thin film having a thickness equal to less than 5 micrometers.

12. The field emission device as claimed in claim 5, further comprising an anode disposed to receive electrons emitted by the plurality of electron emitters, wherein the hydrogen source is disposed on the anode.

13. The field emission device as claimed in claim 5, further comprising an anode plate and a focus grid, wherein the focus grid is disposed intermediate the anode plate and the plurality of electron emitters, and wherein the hydrogen source is connected to the focus grid.

14. The field emission device as claimed in claim 5, wherein the hydrogen source defines a plurality of gate extraction electrodes.

15. The field emission device as claimed in claim 5, further comprising a back plate and an anode plate, wherein the plurality of electron emitters are disposed intermediate the back plate and the anode plate, and wherein the hydrogen source is connected to the back plate.

16. The field emission device as claimed in claim 5, further comprising a plurality of gate extraction electrodes, and wherein the hydrogen source is disposed on the plurality of gate extraction electrodes.

17. A field emission display comprising:

a plurality of electron emitters;

a plurality of phosphors disposed to receive electrons emitted by the plurality of electron emitters; and a hydrogen source, characterized as activated in response to an electron bombardment, the hydrogen source spaced apart from the plurality of electron emitters to define an interspace region therehetween suitable for the movement of hydrogen from the hydrogen source to the plurality of electron emitters, wherein the hydrogen source comprises a metal hydride selected from the group consisting of titanium hydride, vanadium hydride, zirconium hydride, hafnium hydride, niobium hydride, and tantalum hydride.

18. The field emission display as claimed in claim 17, wherein the hydrogen source comprises a metal hydride selected from the group consisting of titanium hydride, vanadium hydride, and zirconium hydride.

19. The field emission display as claimed in claim 17, further comprising a black matrix, wherein the black matrix defines a plurality of openings, wherein the plurality of phosphors are disposed one each within the plurality of openings, and wherein the hydrogen source is disposed on the black matrix.

20. The field emission display as claimed in claim 17, further comprising a reflective layer disposed to reflect light emitted by the plurality of phosphors, wherein the hydrogen source is disposed on the reflective layer.

21. A method for operating a field emission device comprising tie steps of:

providing within the field emission device a hydrogen source made from a metal hydride selected from the group consisting of titanium hydride, vanadium hydride, zirconium hydride, hafnium hydride, niobium hydride, and tantalum hydride; and activating by electron bombardment the hydrogen source to evolve hydrogen, thereby providing the metal of the metal hydride in a form useful for gettering.

* * * * *